United States Patent [19]

Malinchak

[11] 4,429,740

[45] Feb. 7, 1984

[54] COMBINATION GAS PRODUCING AND WASTE-WATER DISPOSAL WELL

[75] Inventor: Raymond M. Malinchak, McKeesport, Pa.

[73] Assignee: The United States of America as represented by the United States Department of Energy, Washington, D.C.

[21] Appl. No.: 299,232

[22] Filed: Sep. 3, 1981

[51] Int. Cl.[3] ..... E21B 41/00

[52] U.S. Cl. ..... 166/53; 166/305 D

[58] Field of Search ..... 166/305 D, 306, 311, 166/101, 106, 105.5, 53

[56] References Cited

U.S. PATENT DOCUMENTS

| | | | |
|---|---|---|---|
| 3,195,633 | 7/1965 | Jacob | 166/305 D |
| 3,333,638 | 8/1967 | Bishop | 166/305 D |
| 3,363,692 | 1/1968 | Bishop | 166/305 D |
| 4,241,787 | 12/1980 | Price | 166/305 D |
| 4,248,305 | 2/1981 | Scarbrough | 166/305 D |

*Primary Examiner*—William F. Pate, III

*Attorney, Agent, or Firm*—Earl L. Larcher; Stephen D. Hamel; Richard G. Besha

[57] ABSTRACT

The present invention is directed to a waste-water disposal system for use in a gas recovery well penetrating a subterranean water-containing and methane gas-bearing coal formation. A cased bore hole penetrates the coal formation and extends downwardly therefrom into a further earth formation which has sufficient permeability to absorb the waste water entering the borehole from the coal formation. Pump means are disposed in the casing below the coal formation for pumping the water through a main conduit towards the water-absorbing earth formation. A barrier or water plug is disposed about the main conduit to prevent water flow through the casing except for through the main conduit. Bypass conduits disposed above the barrier communicate with the main conduit to provide an unpumped flow of water to the water-absorbing earth formation. One-way valves are in the main conduit and in the bypass conduits to provide flow of water therethrough only in the direction towards the water-absorbing earth formation.

8 Claims, 2 Drawing Figures

COMBINATION GAS PRODUCING AND WASTE-WATER DISPOSAL WELL

BACKGROUND OF THE INVENTION

The present invention is directed to the disposal of waste water from subterranean gas-bearing formtions, and, more particularly, to a combination gas-producing and waste-water disposal well wherein the waste water is disposed of in an earth formation underlying the gas-producing earth formation. This invention was made as a result of a contract with the U.S. Department of Energy.

Gas from subterranean gas-bearing earth formations provides a considerable percentage of energy required for satisfying our energy demand. One such source of gas is methane gas from underground coal beds either of the mineable or unmineable type. The coal beds are penetrated by well bores to effect the drainage of methane from the coal bed. The problem associated with producing gas from subterranean earth formations, especially methane from coal beds, is that a considerable amount of contaminant-bearing waste water is produced along with the gas. Disposal of this extracted water has proven to be very difficult due to the need to satisfy environmental standards. The removal of this water away from the well site by tank trucks or pipelines is normally overly expensive.

In the drainage of methane gas from subterranean coal beds, the use of a deep waste-water disposal well in or near the area where several methane gas drainage wells are located has been one approach to disposing of the waste water removed from the coal bed during the production of the methane gas. In such an approach, the water disposal well sufficiently penetrates various earth formations until an earth formation is found that has adequate water absorbing properties to absorb or function at a sink for the water produced from the several gas-producing wells. Inasmuch as this waste-water disposal well is normally spaced among or near the various gas production wells, a waste-water gathering and pumping system is required for transporting the water to the disposal well. While this arrangement is beneficial since it can service more than one production well, and perhaps an entire field, the cost of the surface pumps and piping network collection system for the water represents a considerable expense. As will appear clear upon viewing the description below, the combination gas production and waste-water disposal well of the present invention is a more economical, reliable, and feasible approach than the use of a single waste-water disposal well for the entire gas field.

SUMMARY OF THE INVENTION

It the primary aim or objective of the present invention to provide for the disposal of waste water from subterranean gas-bearing earth formations which will enhance the gas desorption process and increase the recovery factor as well as overcome the environmental contamination problems heretofore encountered with the disposal of the waste water. In accordance with the present invention the waste water is disposed in the gas-producing well into a water-absorbant earth formation. Generally, the waste-water disposal system of the present invention is utilized in a gas recovery well, penetrating a subterranean gas-bearing earth formation such as coal, peat, sands, and shales, wherein the water is displaced from the well into another earth formation, with this further earth formation being characterized by being below the gas-bearing formation and being sufficiently permeable for receiving and absorbing the waste water. To provide this waste water disposal, a bore hole is extended from the surface through the gas-bearing earth formation into the water-absorbing earth formation. A casing is placed in the bore hole and perforations provided through the casing at locations contiguous to the gas-bearing earth formation and the water-absorbing earth formation. Pump means are disposed in the casing intermediate these earth formations and conduit means coupled to the pump means for conveying water therefrom towards the water-absorbing earth formation. Barrier or dam means are disposed in a casing at a location contiguous to and intermediate opposite ends of the conduit means for inhibiting the flow of waste water through the casing except for through the conduit means. Valve means are disposed in the conduit means for providing for the flow of water therethrough towards the water-absorbing earth formation. By employing a combined gas-producing and waste-water disposal well as in the present invention, the requirement for extracting the water from the gas at the surface and then disposing of it in an environmentally safe manner is eliminated.

Other and further objects of the invention will be obvious upon an understanding of the illustrative embodiments about to be described or will be indicated in the appended claims, and various advantages not referred to herein will occur to one skilled in the art upon employment of the invention in practice.

Preferred embodiment of the invention have been chosen for the purpose of illustration and description. The preferred embodiments illustrated are not intended to be exhaustive or to limit the invention to the precise form disclosed. They are chosen and described in order to best explain the principles of the invention and their application in practical use to thereby enable others skilled in the art to best utilize the invention in various embodiments and modifications as are best adapted to the particular use contemplated.

DETAILED DESCRIPTION OF THE INVENTION

Figure 1:
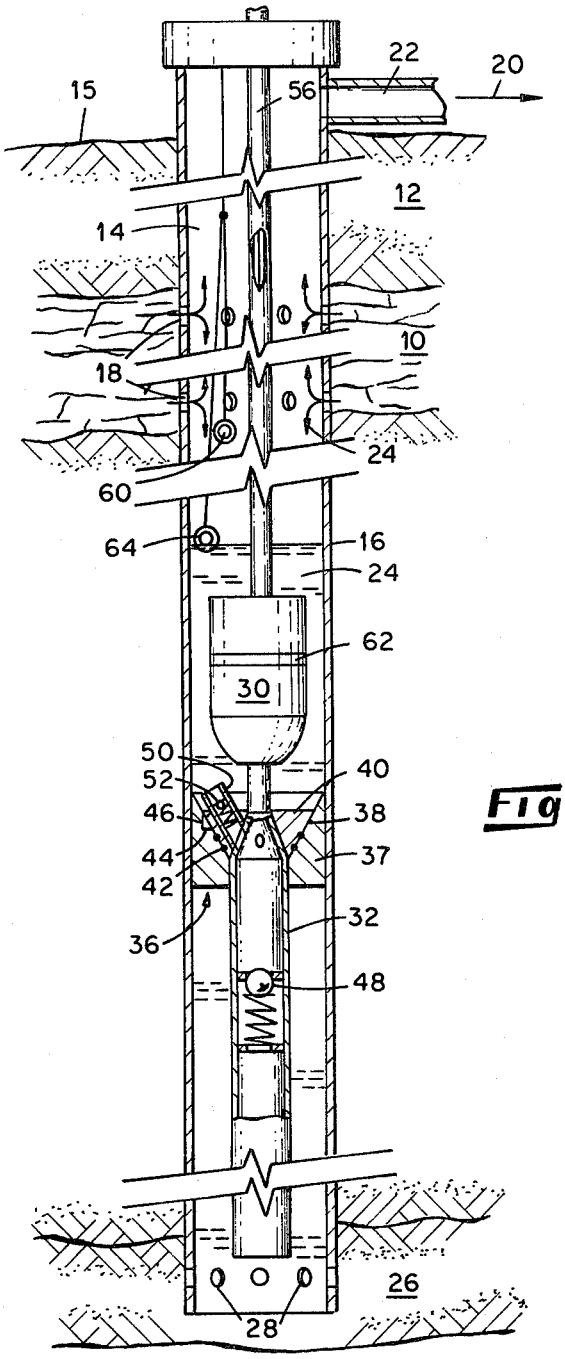
FIG. 1 is a somewhat schematic view of the present invention showing a combined gas and waste-water disposal systm utilized in a well bore penetrating a subterranean gas-bearing earth formation.

As shown in FIG. 1, a subterranean, methane gas-bearing earth formation such as a coal bed 10 is disposed at a location underlying the overburden 12. The coal bed 10 may be either mineable or unmineable since in many mining operations the drainage of the methane prior to mining not only provides a relatively cheap source of methane gas, but also minimizes many of the hazards associated with mining of coal due to the presence of methane gas. To reach the coal bed 10, as in conventional methane drainage operations, a bore hole 14 is drilled from the surface 15 to the coal bed 10 and then a suitable casing 16 is disposed in the bore hole 14 and cemented. A suitable number of perforations 18 are formed in a conventional manner through the casing 16 at a location contiguous to the coal bed 10 for providing for the drainage of the methane as shown generally by the arrows 20. The methane passes from the casing through a conduit 22 to a suitable surface storage site (not shown). During the production of this methane, waste water as generally shown at 24 seeps through the perforations 18 along with the gas and into the casing 16.

In accordance with the present invention, the bore hole 14 is extended below the coal bed 10 to an earth formation generally shown at 26 which is sufficiently permeable, such caused by the presence of natural fractures and the like, so as to provide a sink for the waste water 24 draining from the coal bed 10. The presence of these water-absorbing earth formations may be readily determined by drilling a single bore hole in the coal field and then using standard logging procedures to determine the permeability and the water absorbing properties of the earth formations underlying the gas-producing coal bed 10. The casing 16 is preferably extended into the water-absorbing earth formation 26 to inhibit caving and the like which would reduce the level of water absorption by the earth formation 26. Perforations 28 similar to perforations 18 are provided in casing 16 contiguous to the water-absorbing earth formation 26 to provide passageways for the water from the casing into the earth formation 26.

In order to displace the waste water from within the casing 16 into the water-absorbing earth formation 26, a submersible pump 30 is disposed in the casing 16 at a location below the gas-bearing coal formation 10. A power lead 31 is suitable shielding casing extends from the pump 30 to a power source (not shown) at the surface. Coupled to the bottom end of the pump 30 is a pipe or conduit 32 which projects from the pump 30 to several feet therebelow. The particular length of this conduit 32 is not critical but should be of sufficient length to contain the necessary valving and be surrounded by a baffle or water plug to inhibit water flow through the casing 16 except for within the conduit 32.

A satisfactory baffle or water plug is generally shown at 36 but may comprise any suitable mechanism which will plug the casing 16 around the conduit 32 and support the pump in the casing. Satisfactory results have been achieved with a water plug 36 formed of an annular ring 37 affixed to the casing wall or casing coupling in any suitable manner such as welding and provided with an inwardly converging upper wall portion 38. The conduit 32 is provided with a tapered or convex annular shoulder 40 affixed thereto. The diameter of the shoulder 40 is greater than the opening through the ring 37 so that when the convex-shaped shoulder 40 bears against the concave-shaped surface 38 of the ring 37, a suitable support for the pump assembly is provided. Further, by utilizing a concave tapered ring 37 and a convex tapered shoulder 40, the insertion of the conduit 32 and the pump assembly into the casing is greatly facilitated due to the guiding action provided by these tapered surfaces. To ensure that the water plug 36 is essentially liquid-tight, a suitable seal, such as provided by one or more O-rings 42, is disposed between the tapered shoulder 40 and the annular ring 37. Also, a keyway 44 is disposed in the ring 37 and a lug 46 is disposed in the tapered shoulder 40 to prevent rotation of the conduit 32 when it is inserted within the casing 16. By preventing rotation of the conduit 32, the pump 30 will be maintained in a fixed position within the casing 16.

A one-way valve, such as a ball-check valve 48, is disposed within the conduit 32 at a location below the water plug 36. This check valve 48 is oriented to permit the flow of water downwardly through the conduit 32 while preventing the flow of water in the opposite direction through the conduit 32 towards the pump 30.

A plurality of pump bypass conduits, one of which is shown at 50, are disposed at suitable locations above or in the plug 36 so as to be in registry with the interior of the conduit 32 and with the interior of the casing 16 at a location above the water plug 36. A suitable location of such bypass conduits is within the tapered shoulder 40 of the water plug 36. These bypass conduits 50, as best shown in FIG. 2, each contains a check valve 52 which allows for the flow of water 24 into the conduit 32 from a location in the casing 16 above the water plug 36 while inhibiting flow in the opposite direction.

Figure 2:
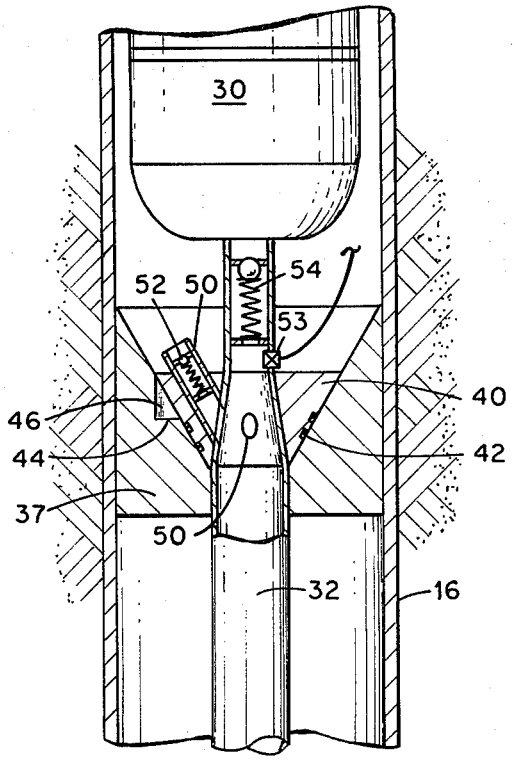
FIG. 2 is a broken away portion of a system corresponding to that of FIG. 1 but showing a modification thereof.

The embodiment shown in FIG. 2 is a modification of the FIG. 1 embodiment in that the conduit 32 is provided with a check valve 54 an pressure transducer 53 above the largest diameter of shoulder 40 and generally above bypass conduits 50. This modification allows for the flow of the water through the bypass conduits 50 without the flow of water through check valve 54 during operations where the water level is below a prescribed level and facilitates pressure transducer measurements, as will be described in detail below.

A suitable lift cable 56 is attached to the pump 30 and conduit 32 for the insertion or removal thereof for maintainence or repairs. The operation of the pump may be controlled by a high-water level switch 60 disposed at a suitable location below the coal bed 10. When the water level 24 rises to this level, the pump 30 is switched on to receive the water through pump opening 62 and displace it through the conduit 32 and check valve 48 into the water-absorbing earth formation 26. This pumping operation continues until the level of the water 24 recedes to to a low-level cutoff switch as shown at 64. At this time the pump 30 stops and the check valve 48 closes to maintain a pressure loading on the water 24 below the check valve in the casing 16. This arrangement also assures that once the pump 30 is turned off, the water 24 will not flow back up through the conduit 32 into the pump assembly. When the pressure in the casing 16 below the check valve 48 drops sufficiently due to the water absorption, the water may flow through the pump bypass conduits 50 into the conduit 32. This water flow will usually have a sufficient head to open the valve 48 and allow for the water 24 to flow through the pump bypass conduits 50 into the formation 26. However, in the event this water flow through the bypass conduits 50 is insufficient, and the water level rises to the high-level switch 60, the pump 30 will again turn on to drop the water level in the casing 16 to the low-level switch 64.

In addition, as shown in the FIG. 2 modification, a pressure transducer 53, may be placed at a suitable location in the conduit 32 to provide an indication of pump performance and water elevation. This pressure data would provide an indication of pump discharge pressure as well as to the hydraulic resistance of the water absorbing earth formation 26.

It will be seen that the present invention provides a combined gas-production and waste-water disposal system which overcomes considerable environmental problems as well as reducing the expenses heretofore encountered during methane drainage from subterranean coal beds.

What is claimed is:

1. A waste-water disposal system for use in a gas recovery well penetrating a subterranean gas-bearing earth formation wherein water discharges along with the gas from the gas-bearing earth formation and wherein the water is displaced from the well into a further earth formation underlying the gas-bearing earth formation and characterized by sufficient permeability for receiving said water, comprising:

a bore hole extending from the surface through the gas-bearing earth formation to said further earth formation;

a casing in said bore hole;

perforations projecting through said casing at locations contiguous to said gas-bearing earth formation;

pump means disposed in said casing intermediate said gas-bearing earth formation and said further earth formation;

conduit means coupled to said pump means for conveying water therefrom towards said further earth formation;

barrier means disposed in said casing at a location contiguous to and intermediate opposite ends of said conduit means for inhibiting the flow of water through said casing except through said conduit means;

valve means in said conduit means providing for the flow of water therethrough toward said further earth formation;

further conduit means in registry with the interior of the first-mentioned conduit means and the interior of said casing at a location above said barrier means for conveying water from said casing into the first-mentioned conduit means and thereby bypassing said pump means; and valve means disposed in said further conduit means for providing flow of water therethrough towards the first-mentioned conduit means.

2. The waste-water disposal system as claimed in claim 1, wherein the first-mentioned valve means and said further valve means are one-way valves for respectively providing flow of water through the first-mentioned conduit means and said further conduit means only in the direction towards said further earth formation.

3. The waste-water disposal system claimed in claim 2, wherein said further conduit means communicate with the interior of the first conduit means at a location intermediate said pump means and the first-mentioned valve means.

4. The waste-water disposal system as claimed in claim 2, wherein the first-mentioned valve means are disposed in the first mentioned conduit means at a location intermediate said pump means and the level of communication of said further conduit means with the interior of the first-mentioned conduit means.

5. The waste-water disposal system claimed in claim 1, wherein said barrier means comprises an annular ring that is affixed to said casing and has a concave upper surface, a shoulder is disposed on the first-mentioned conduit means and has a convex lower surface of a diameter greater than the opening through said annular ring, the convex surface of said shoulder is abuttable against the concave surface of said annular ring for supporting the pump means and the first-mentioned conduit means in said casing, and seal means are disposed between said convex surface and said concave surface for inhibiting flow of water therebetween.

6. The waste-water disposal system claimed in claim 5, wherein said further conduit means are carried by said shoulder.

7. The waste-water disposal system claimed in claim 1, wherein first switch means are disposed in said casing for initiating the operation of the pump means when the water in said casing above the barrier means rises to a selected level, and wherein second switch means are disposed in said casing below said first switch means for terminating the operation of said pump means when the water in said casing above the barrier means drops to a selected level.

8. The waste-water disposal system as claimed in claim 1, wherein transducer means are disposed in said conduit for providing signals indicative of pump discharge pressure and hydraulic resistance of said further earth formation.

* * * * *